US010517378B2

(12) United States Patent
Browning

(10) Patent No.: US 10,517,378 B2
(45) Date of Patent: Dec. 31, 2019

(54) HAMMOCK

(71) Applicant: George Browning, Marietta, GA (US)

(72) Inventor: George Browning, Marietta, GA (US)

( * ) Notice: Subject to any disclaimer, the term of this patent is extended or adjusted under 35 U.S.C. 154(b) by 498 days.

(21) Appl. No.: 15/156,464

(22) Filed: May 17, 2016

(65) Prior Publication Data

US 2016/0338477 A1 Nov. 24, 2016

Related U.S. Application Data

(60) Provisional application No. 62/164,514, filed on May 20, 2015.

(51) Int. Cl.
*A45F 3/22* (2006.01)
*A47G 9/08* (2006.01)

(52) U.S. Cl.
CPC . *A45F 3/22* (2013.01); *A47G 9/08* (2013.01)

(58) Field of Classification Search
CPC .... A45F 3/22; A45F 3/26; A47G 9/08; A61G 7/1023; A61G 7/1051; A61G 7/1055; A61G 1/01; E04H 15/04; E04H 15/324
See application file for complete search history.

(56) References Cited

U.S. PATENT DOCUMENTS

| | | | | |
|---|---|---|---|---|
| 803,091 | A * | 10/1905 | Brayshaw | A45F 3/22 5/122 |
| 1,071,764 | A * | 9/1913 | Lowrimore | A45F 3/22 5/122 |
| 1,120,234 | A * | 12/1914 | Palmer | A45F 3/22 5/123 |
| 4,021,868 | A | 5/1977 | Fueslein | |
| 5,971,480 | A | 10/1999 | Maschke | |
| 6,185,763 | B1 | 2/2001 | Hennessy | |
| 6,948,206 | B1 | 9/2005 | Valencia | |
| 7,178,182 | B2 | 2/2007 | Brenner | |
| 8,806,676 | B2 * | 8/2014 | Reeb | A45F 3/24 5/120 |
| 8,893,328 | B1 | 11/2014 | Kroeger | |

* cited by examiner

*Primary Examiner* — Nicholas F Polito

(57) ABSTRACT

Implementations of a hammock are provided. In some implementations, the hammock may be configured to provide a head pocket that supports the head of a user without straining the neck. In some implementations, the hammock may be configured to provide two arm rests that position the arms of a user alongside their body, outside the confines of the interior compartment of the hammock. In some implementations, the hammock may be configured to provide a leg well that supports the legs of a user without straining the knees. A method of constructing a hammock having a central portion that is elevated when hung is disclosed. By elevating the central portion of the hammock, the mid-line of a user's body (e.g., the lower back, hips, and/or legs) may be raised to the same or similar elevation as the head pocket and/or the leg well of the hammock.

5 Claims, 8 Drawing Sheets

HAMMOCK

CROSS REFERENCE TO RELATED APPLICATION

This application claims the benefit of U.S. Provisional Application Ser. No. 62/164,514, filed on May 20, 2015, and is incorporated herein by reference in its entirety.

TECHNICAL FIELD

This disclosure relates to implementations of a hammock.

BACKGROUND

In general, hammocks are used to provide a sleeping or resting place that provides shelter from inclement weather, insects, and ground dwelling creatures. Being suspended above ground, hammocks provide a dry, clean surface to rest upon and may be used almost anywhere regardless of terrain.

Conventional hammocks include a hammock surface of fabric or netting suspended between two anchor points by two or more supports lines.

However, conventional hammocks have several disadvantages. First, the suspension of the hammock causes the hammock to sag and assume a generally parabolic shape when a person is resting thereon. Second, the sag of the hammock will place strain on the head, neck and shoulders as well as the legs and knees of the occupant. Third, when resting on the hammock, the sides of the hammock have a tendency to wrap around and envelope the occupant thereby pinning the arms against the body and/or the legs together. These and other disadvantages inherent to conventional hammocks make their use unacceptable for extended duration.

SUMMARY OF THE INVENTION

Implementations of a hammock are provided. In some implementations, the hammock is configured to be suspended between two trees or other vertical supports.

In some implementations, the hammock may be configured to provide a head pocket that supports the head of a user without straining the neck.

In some implementations, the hammock may be configured to provide two arm rests that position the arms of a user alongside their body, outside the confines of the interior compartment of the hammock. In some implementations, the arm rests form when the hammock is suspended.

In some implementations, the hammock may be configured to provide a leg well that supports the legs of a user without straining the knees. In some implementations, the leg well of the hammock may be configured to only support the portions of the legs above the calves of a user. In this way, the hammock may support the legs of the user without placing pressure on the knees. Further, this configuration of the hammock's leg well allows the feet of a user to move freely and prevents them from being pressed together.

A method of constructing a hammock having a central portion that is elevated when hung is disclosed. By elevating the central portion of the hammock, the mid-line of a user's body (e.g., the lower back, hips, and/or legs) may be raised to the same or similar elevation as the head pocket and/or the leg well of the hammock. In this way, the user may have a "flat lie" (i.e., the head, hips and/or legs may be positioned at the same or similar elevation) and thereby not assume the generally parabolic shape associated with traditional hammocks.

In some implementations, the hammock may be used in conjunction with a sleeping bag.

In some implementations, strips of nylon webbing may be secured to the underside of the hammock in various patterns to increase the load bearing weight of the hammock.

In some implementations, the hammock may incorporate a foot bag. In some implementations, the foot bag may be secured about the exit opening of the leg well. In some implementations, the foot bag may be configured to envelop the feet of the user and thereby protect them from the elements (e.g., wind and/or rain).

In some implementations, the leg well of the hammock may be configured to fully encircle the legs of a user and be supported by a single suspension line. In some implementations, a rod may be used to hold open the exit opening of the leg well. In this way, the exit opening of the leg well will be prevented from collapsing and thereby compressing the legs of a user together.

DETAILED DESCRIPTION

Figure 1A:
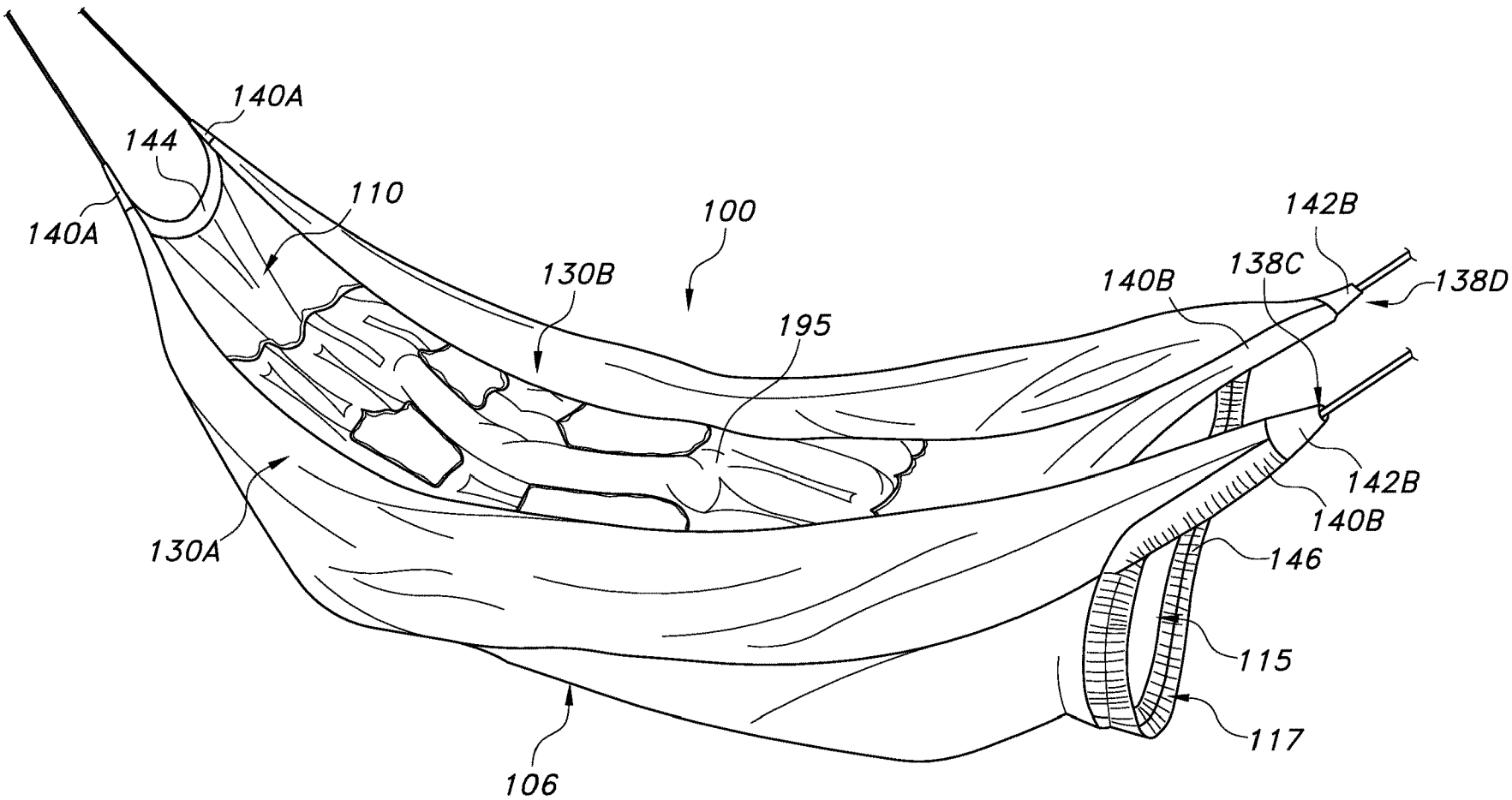
FIGS. 1A-1C and 2A-2B illustrate an example implementation of a hammock according to the principles of the present disclosure.

FIGS. 1A-1C and 2A-2B illustrate an example implementation of the hammock 100 according to the principles of the present disclosure. In some implementations, the hammock 100 is configured to be suspended between two trees or other vertical supports. In some implementations, the hammock 100 may be configured to provide a head pocket 110 that supports the head of a user without straining the neck. In some implementations, the hammock 100 may be configured to provide two arm rests 130 that position the arms of a user alongside their body, outside the confines of the interior compartment of the hammock 100. In some implementations, the hammock 100 may be configured to provide a leg well 115 that supports the legs of a user without straining the knees. A method of constructing a hammock 100 having a central portion 106 that is elevated when hung is disclosed. By elevating the central portion 106 of the hammock 100, the mid-line of a user's body (e.g., the lower back, hips, and/or legs) may be raised to the same or similar elevation as the head pocket 110 and/or the leg well 115 of the hammock 100.

As shown in FIG. 1A, in some implementations, the hammock 100 may have a head pocket 110 and a leg well 115. In some implementations, the hammock 100 may further include a first suspension system 140A and a second suspension system 140B (collectively 140) located adjacent the head pocket 110 and leg well 115 thereof, respectively (see, e.g., FIG. 1A).

A shown in FIG. 1A, in some implementations, the hammock 100 may be configured so that the legs of a user extend from the leg well 115 thereof. In this way, the hammock 100 supports the legs behind the calves without placing pressure on the knees of a user. In some implementations, the exit opening 117 of the leg well 115 may be positioned below the second suspension system 140B (see, e.g., FIG. 1A).

Figure 1B:
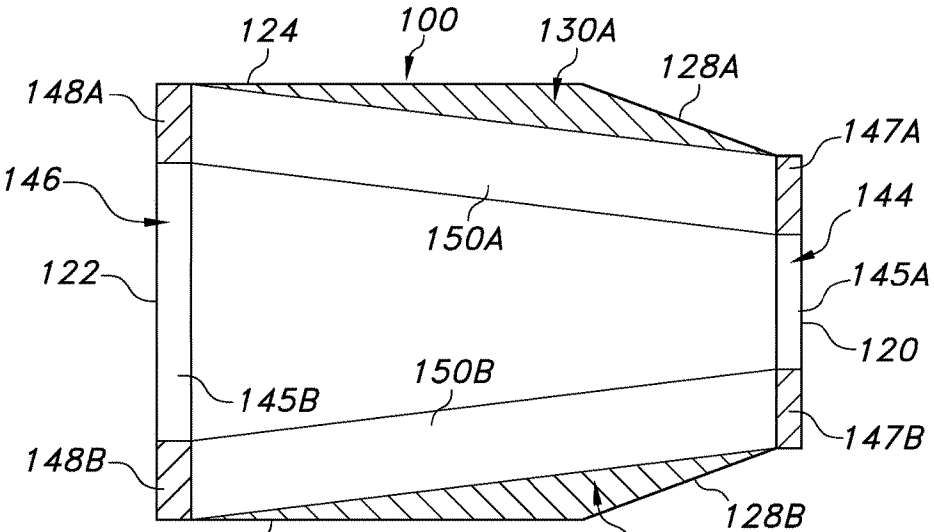
Figure 1C:
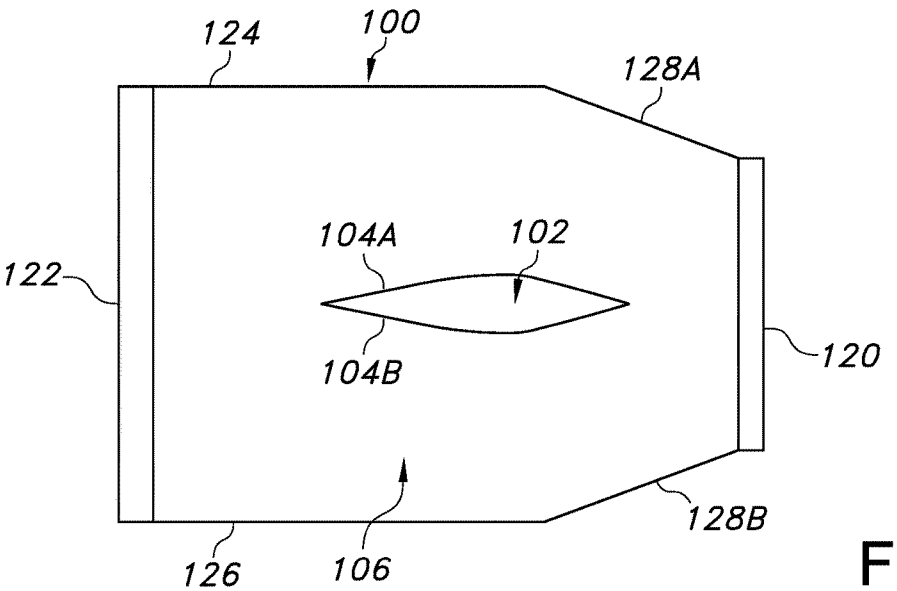

As shown in FIGS. 1B and 1C, in some implementations, the hammock 100 may have a top side 120, a bottom side 122, a left side 124, and a right side 126. In some implementations, the bottom side 122 of the hammock 100 may be wider than the top side 120 (see, e.g., FIG. 1B). In some implementations, the hammock may have a first side edge 128A and a second side edge 128B (collectively 128).

In some implementations, a first side edge 128A may extend between the top side 120 and the left side 124 of the hammock 100 (see, e.g., FIG. 1B).

In some implementations, a second side edge 128B may extend between the top side 120 and the right side 126 of the hammock 100 (see, e.g., FIG. 1B).

In some implementations, one or both of the side edges 128 may taper such that the hammock 100 reduces in width towards the top side 120 of the hammock 100 (see, e.g., 128A and 128B of FIG. 1B).

Figure 2A:
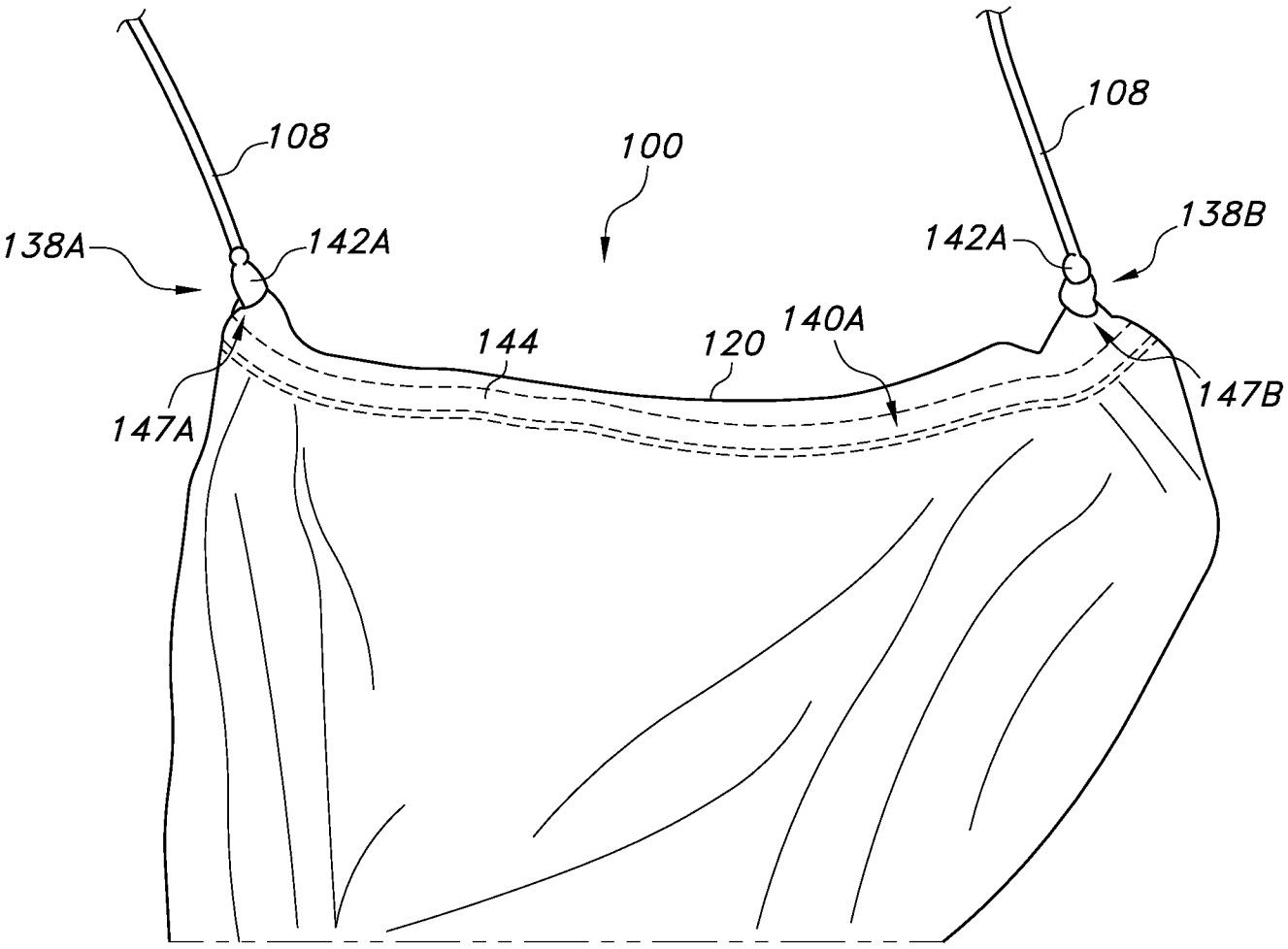
Figure 2B:
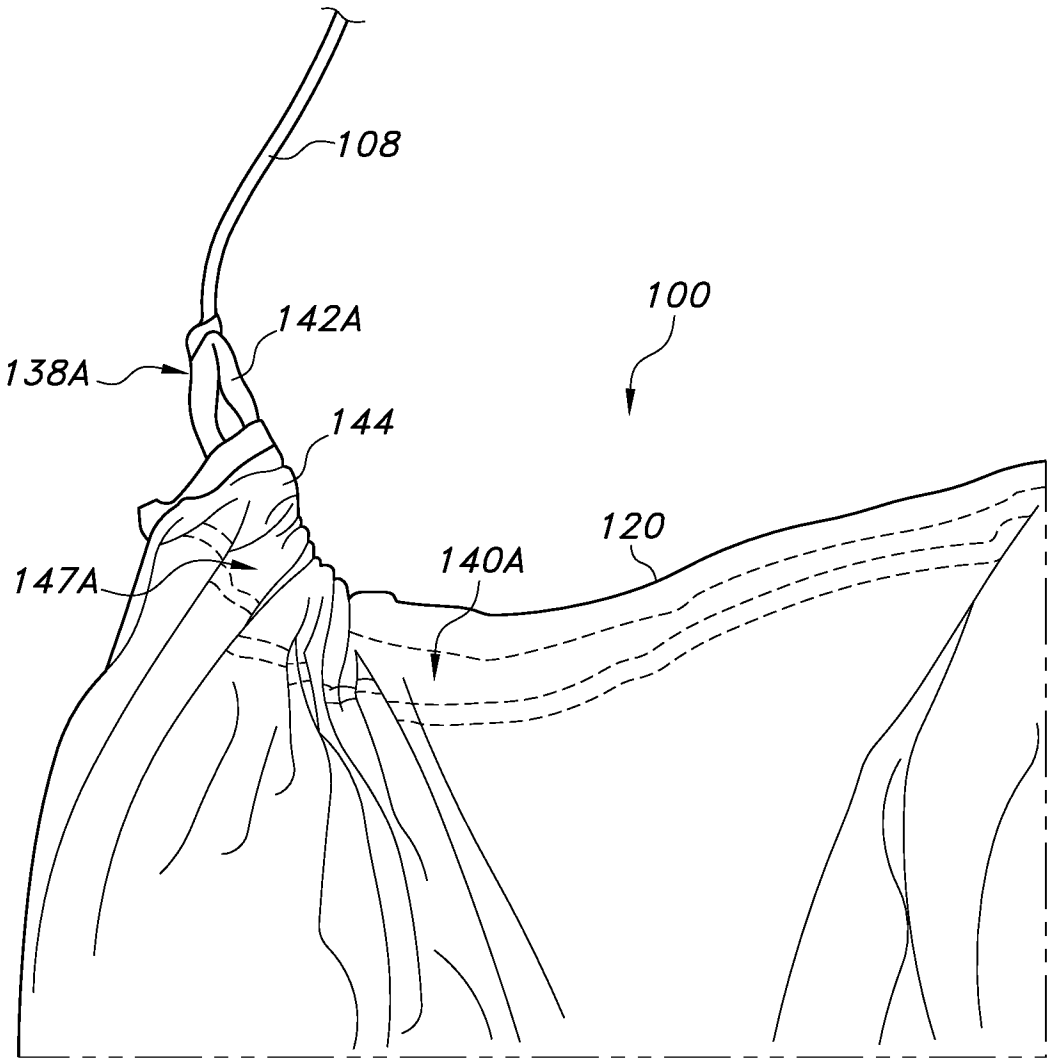

As shown in FIGS. 2A-2B, in some implementations, the first suspension system 140A may comprise a first length of nylon webbing 142A secured within a first fold 144 of the top side 120 of the hammock 100. In some implementations, a portion of the nylon webbing 142A may be sewn into place within a first fold 144 of the hammock 100 (see, e.g., FIG. 2A). In some implementations, the nylon webbing 142A may be sewn in place within a middle (or central) portion 145A of the first fold 144 (see, e.g., FIG. 1B). In some implementations, the unsecured material comprising a first side 147A and a second side 147B of the first fold 144 may be compressed (or pleated) towards the middle portion 145A of the first fold 144 (see, e.g., FIGS. 1B, 2A, and 2B). In this way, the head pocket 110 of the hammock 100 may be formed. This construction may also prevent the nylon webbing 142A from tearing the hammock 100 along the first fold 144 during use.

As shown in FIGS. 1A and 1B, in some implementations, the second suspension system 140B may comprise a second length of nylon webbing 142B secured within a second fold 146 of the bottom side 122 of the hammock 100. In some implementations, a portion of the nylon webbing 142B may be sewn into place within the second fold 146 of the hammock 100 (see, e.g., FIG. 1A). In some implementations, the nylon webbing 142B may be sewn in place within a middle (or central) portion 145B of the second fold 146 (see, e.g., FIG. 1B). In some implementations, the unsecured material comprising a first side 148A and a second side 148B of the second fold 146 may be compressed (or pleated) towards the middle portion 145A of the second fold 146 (see, e.g., FIG. 1B). In this way, the leg well 115 of the hammock 100 may be formed. This construction may also prevent the nylon webbing 142B from tearing the hammock 100 along the fold 146 during use.

As shown in FIGS. 1A, 2A, and 2B, in some implementations, both ends of the first length of nylon webbing 142A and the second length of nylon webbing 142B (collectively 142) may be configured to provide a loop 138A, 138B, 138C, 138D thereon. In some implementations, a suspension line 108 may be secured through each loop 138 which in turn may be used to secure each end of the hammock 100 to a tree and/or other support structure. In some implementations, the loops 138 may be formed by folding and securing an end portion of the nylon webbing 142 to itself. In some implementations, loops 138 may be formed by any method known to one of ordinary skill in the art having the benefit of the present disclosure.

As shown in FIG. 1B, in some implementations, the middle portion 145B of the second fold 146 may be wider than the middle portion 145A of the first fold 144. In this way, two longitudinal stress lines 150A, 150B (collectively 150) may be formed. In some implementations, the stress lines 150 may taper along there length. In some implementations, the stress lines 150 may extend between the top side 120 and the bottom side 122 of the hammock 100 (see, e.g., FIG. 1B).

As shown in FIGS. 1A and 1B, in some implementations, the hammock 100 may be further comprised of a first arm rest 130A and a second arm rest 130B (collectively 130). In some implementations, the first arm rest 130A may be the portion of the hammock 100 that lies between the left side 124, the first side edge 128A, and the stress line 150A. In some implementations, the second arm rest 130B may be the portion of the hammock 100 that lines between the right side 126, the second side edge 128B, and the stress line 150B. In some implementations, the arm rest 130 form when the hammock 100 is suspended (see, e.g., FIG. 1A). In some implementations, the arm rests 130 allow a user to rest their arms alongside their body without the arms being trapped between the material of the hammock 100 and the body of the user.

As shown in FIG. 1C, in some implementations, the hammock 100 may be manufactured to minimize the sag thereof when suspended between two supports. In some implementations, material may be removed from the hammock 100 to produce an opening 102 that extends therethrough (see, e.g., FIG. 1C). In some implementations, the opening 102 may have a first side edge 104A and a second side edge 104B (collectively 104). In some implementations, the side edges 104 may taper to a point along a top side and a bottom side of the opening 102 (see, e.g., FIG. 1C). In some implementations, the material of the hammock 100 may be removed so that the opening 102 has the general shape of a diamond. In some implementations, the opening 102 may be any suitable shape. In some implementations, the first side edge 104A may be joined along its length to the second side edge 104B of the opening 102 (see, e.g., FIG. 1A). In this way, the central portion 106 may be elevated and the sag of the hammock 100 reduced relative to the head pocket 110 and the leg well 115. In some implementations, the central portion 106 may be elevated so that the mid-line of a user's body (e.g., the lower back, hips, and/or legs) is raised to the same or similar elevation as the head pocket 110 and/or the leg well 115. In some implementations, by increasing or decreasing the initial size of the opening 102, and thereby the length of the side edges 104, the central portion 106 of the hammock 100 may be elevated or lowered, respectively, relative to the head pocket 110 and/or leg well 115.

Figure 3:
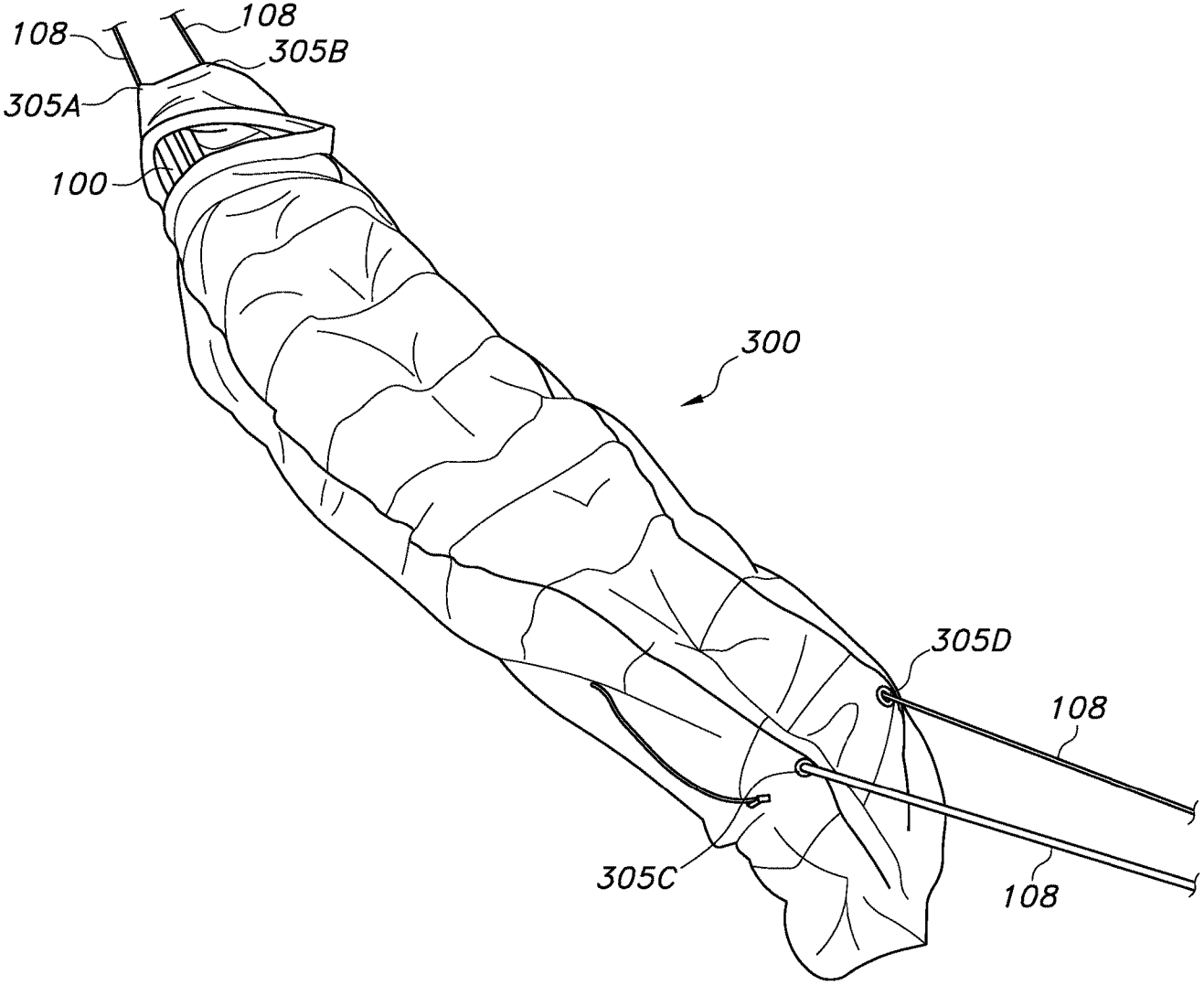
FIG. 3 illustrates the hammock of FIG. 1A being used in conjunction with a sleeping bag.

As shown in FIG. 3, in some implementations, the hammock 100 may be used in conjunction with a sleeping bag 300. In some implementations, the sleeping bag 300 may have openings 305A, 305B, 305C, 305D (collectively 305) extending therethrough. In some implementations, the openings 305 may be positioned so that they are located adjacent the loops 138 of each length of nylon webbing 142A, 142B. In this way, suspension lines 108 secured to the loops 138 may be extended through the openings 305 of the sleeping bag 300 (see, e.g., FIG. 3).

Figure 4B:
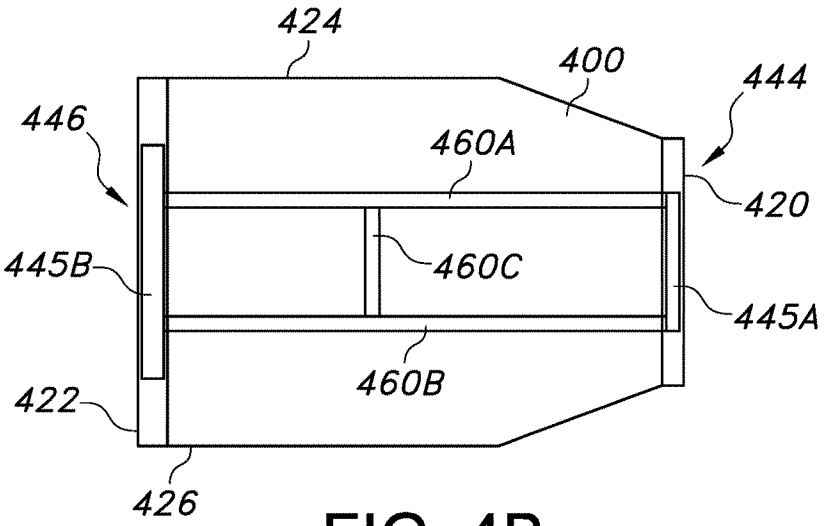
FIGS. 4A-4C illustrate another example implementation of the hammock 400 in accordance with the present disclosure.
Figure 4A:
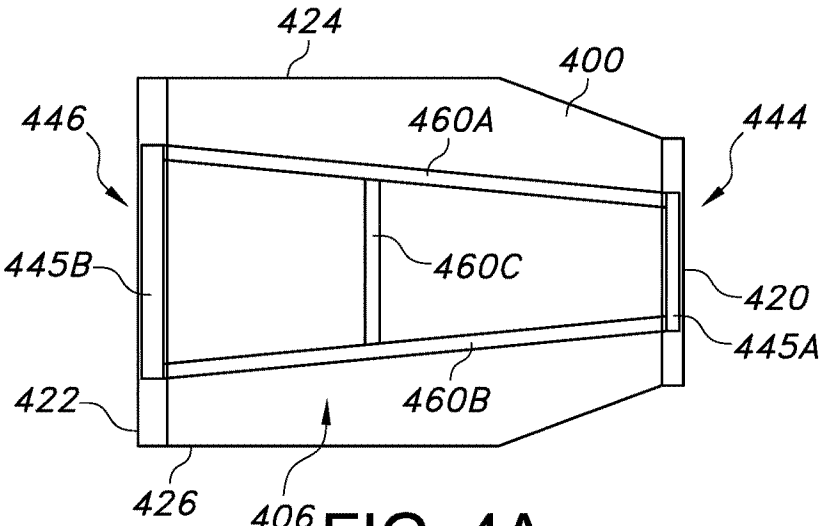
Figure 4C:
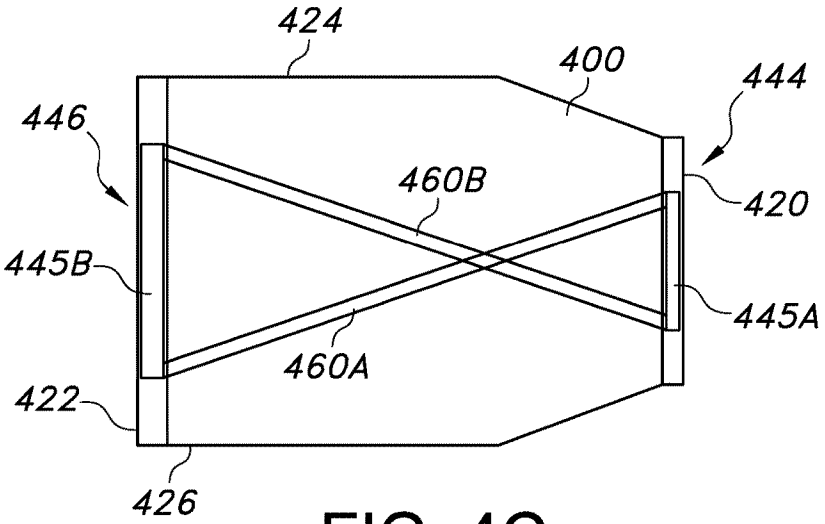

FIGS. 4A-4C illustrate another example implementation of the hammock 400 in accordance with the present disclosure. The hammock 400 is similar to the hammock 100 except that the hammock 400 has additional strips of nylon webbing 460 thereon. In some implementations, the strips of nylon webbing 460 may increase the load bearing weight of the hammock 400. In some implementations, the nylon webbing 460 may be similar to the nylon webbing 142A, 142B discussed elsewhere herein. In some implementations, the strips of nylon webbing 460 may be attached to the underside of the hammock 400. In some implementations, the strips of nylon webbing 460 may be secured between two or more layers of material from which the hammock 400 may be comprised.

As shown in FIG. 4A, in some implementations, the hammock 400 may have a first strip of nylon webbing 460A and a second strip of nylon webbing 460B extending from a left side and right side of the middle portion 445A of the first fold 444, respectively, to the left side and right side of the middle portion 445B of the second fold 446, respectively. In some implementations, a third strip of nylon webbing 460C may extend between the first and second strips of nylon webbing 460A, 460B (see, e.g., FIG. 4A). In some implementations, the third strip of nylon webbing 460C may extend across the central portion 406 of the hammock 400 (see, e.g., FIG. 4A).

As shown in FIG. 4B, in some implementations, the hammock 400 may have a first strip of nylon webbing 460A and a second strip of nylon webbing 460B extending from a left side and right side of the middle portion 445A of the first fold 444, respectively, to the middle portion 445B of the second fold 446. In some implementations, the first and second strips of nylon webbing 460A, 460B run parallel to each other between the top side 420 and the bottom side 422 of the hammock 400 (see, e.g., FIG. 4B). In some implementations, a third strip of nylon webbing 460C may extend between the first and second strips of nylon webbing 460A, 460B (see, e.g., FIG. 4B). In some implementations, the third strip of nylon webbing 460C may extend across the central portion 406 of the hammock 400.

As shown in FIG. 4C, in some implementations, the hammock 400 may have a first strip of nylon webbing 460A and a second strip of nylon webbing 460B extending from a left side and right side of the middle portion 445A of the first fold 444, respectively, to the right side and left side of the middle portion 445B of the second fold 446, respectively. In this way, the first and second strips of nylon 460A, 460B cross each other (see, e.g., FIG. 4C).

Figure 5A:
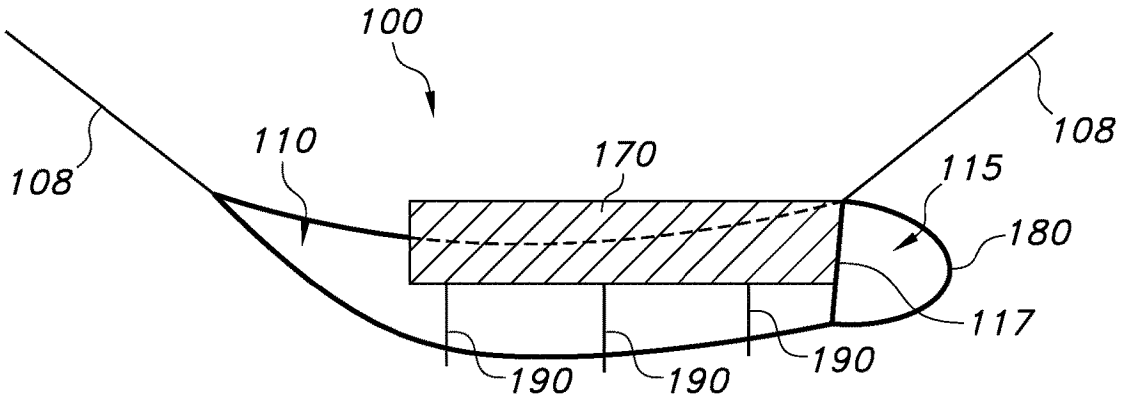
FIGS. 5A and 5B illustrate the hammock of FIG. 1A being used in conjunction with a blanket.
Figure 5B:
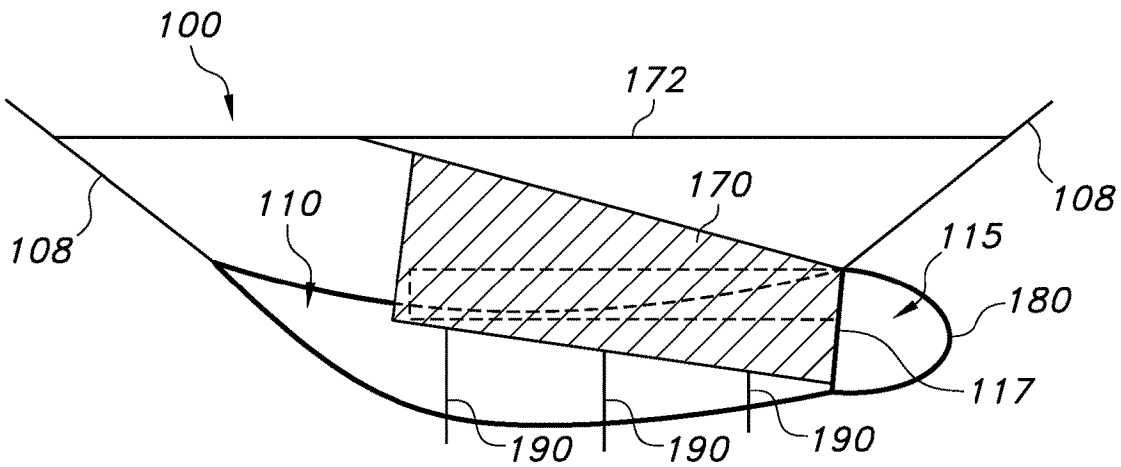

As shown in FIGS. 5A and 5B, in some implementations, the hammock 100 may include a blanket 170. In some implementations, the blanket 170 may be secured about at least a portion of the exit opening 117 of the leg well 115 (see, e.g., FIG. 5A). In some implementations, the blanket 170 may be attached to the portions of the left side 124 and right side 126 of the hammock 100 that are adjacent the leg well 115. In some implementations, the blanket 170 may be configured to extend from the end of the leg well 115 to the head pocket 110 (see, e.g., FIG. 5A). In this way, the torso, head, neck, and/or upper portion of a user's legs may be covered by the blanket 170 (see, e.g., FIG. 5A). In some implementations, the blanket 170 may be peaked by securing it to a ridge line 172 extending longitudinally across the hammock 100 (see, e.g., FIG. 5B). In this way, a user may be protected from the elements (e.g., rain and/or wind) without the blanket 170 resting directly on them. In some implementations, the blanket 170 may be an integral part of the hammock 100.

In some implementations, a plurality of straps 190 may be used to secure the blanket 170 to the hammock 100 (seem e.g., FIG. 5A). In some implementations, the straps 190 may extend underneath the hammock 100 between a first side and a second side of the blanket 170 (see, e.g., FIG. 5A).

In some implementations, as shown in FIGS. 5A and 5B, the hammock 100 may incorporate a foot bag 180. In some implementations, the foot bag 180 may be secured about the exit opening 117 of the leg well 115 (see, e.g., FIG. 5A). In some implementations, the foot bag 180 may be configured to envelop the user's feet and thereby protect them from the elements (e.g., wind and/or rain).

Figure 6B:
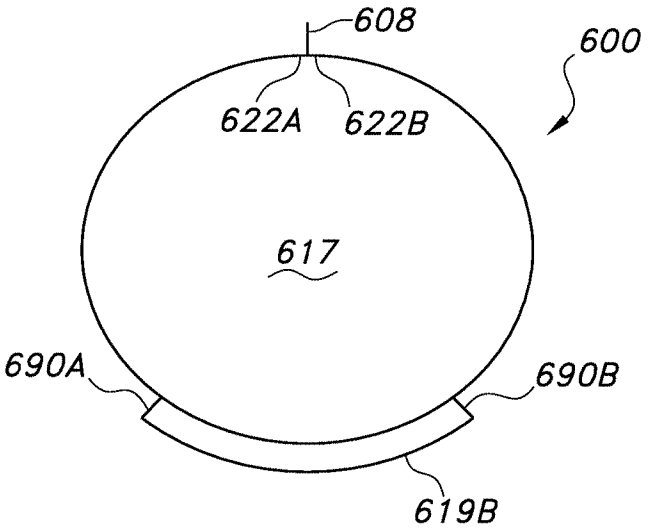
FIGS. 6A-6C illustrate yet another example implementation of the hammock 600 in accordance with the present disclosure.
Figure 6A:
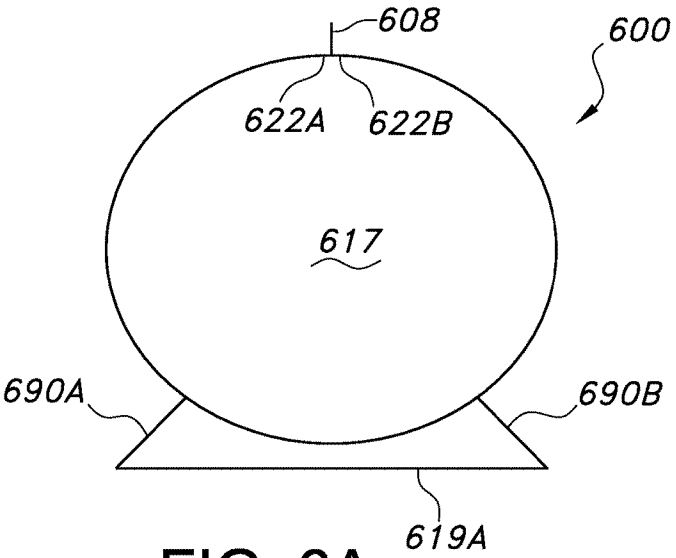
Figure 6C:
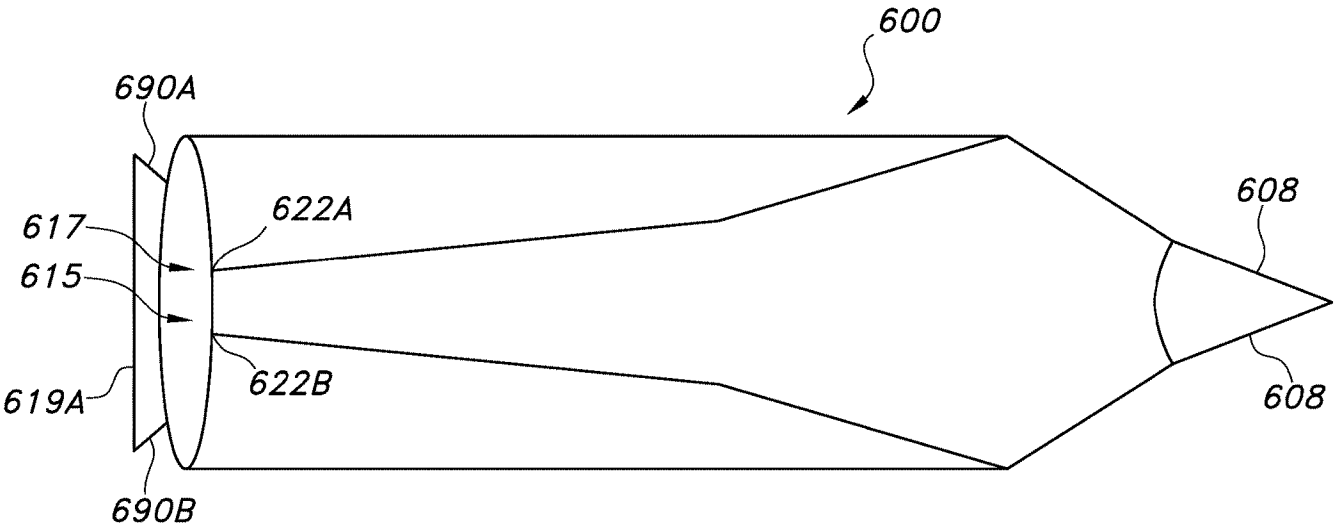

FIGS. 6A-6C illustrate another example implementation of the hammock 600 in accordance with the present disclosure. The hammock 600 is similar to the hammock 100, 400 except that the leg well 615 of the hammock 600 is configured to fully encircle the legs of a user and be supported by a single suspension line 608 (see, e.g., FIGS. 6A and 6B). In some implementations, a rod 619A, 619B may be used to hold open the exit opening 617 of the leg well 615 (see, e.g., FIGS. 6A and 6B). In this way, the exit opening 617 of the leg well 615 will be prevented from collapsing and thereby compressing the legs of a user together.

As shown in FIGS. 6A and 6B, in some implementations, a first end 622A and a second end 622B of the bottom side 622 of the hammock 600 may be joined together. In this way, the exit opening 617 of the leg well 615 may fully encircle the legs of a user lying on the hammock 600.

As shown in FIGS. 6A and 6B, in some implementations, there may be a first strap 690A and a second strap 690B (collectively straps 690) extending from the underside of the hammock 600 adjacent the exit opening 617 of the leg well 615. In some implementations, the straps 690 may be configured to secure a rod 619 therebetween. In this way, the rod 690 may be used to hold open the exit opening 617 of the leg well 615. In some implementations, a rod 619 may be secured directly to the underside of the hammock 600 adjacent the exit opening 617 of the leg well 615 (not shown). In some implementations, the rod 619 may be positioned above the exit opening 617 of the leg well 615 (not shown).

In some implementations, the rod 619A may be straight (see, e.g. FIG. 6A). In some implementations, the rod 619B may be curved (see, e.g., FIG. 6B). In some implementations, the rod 619 may be manufactured from a rigid material (e.g., rod 619A) or a flexible material (e.g., rod 619B). In some implementations, the rod 619 may be manufactured from an aluminum alloy, a titanium allow, and/or a steel alloy. In some implementations, the rod 619 may be manufactured from a carbon fiber material. In some implementations, the rod 619 may be manufactured from any suitable material.

In some implementations, the hammock 100, 400, 600 may be manufactured from a single piece of material. In this way, the hammock may be ultralight. In some implementations, the hammock 100, 400, 600 may be manufactured from multiple layers of material. In some implementations, the hammock 100, 400, 600 may be manufactured from any natural, synthetic, and/or semi-synthetic material. In some implementations, the hammock may be manufactured from a waterproof and/or windproof fabric.

In some implementations, the nylon webbing 142 and/or the strips of nylon webbing 460 may be manufactured from a nylon material. In some implementations, the nylon webbing 142 and/or the strips of nylon webbing 460 may be manufactured from a poly-paraphenylene terephthalamide (e.g., Kevlar®) material. In some implementations, the nylon webbing 142 and/or the strips of nylon webbing 460 may be manufactured from any suitable natural, synthetic, and/or semi-synthetic material.

In some implementations, two hammocks 100, 400, 600 may be hung side-by-side.

In some implementations, by removing sag from the central portion 106, 406 of the hammock 100, 400, 600 as discussed above, a user may not need to lie diagonally across the hammock 100, 400, 600 to be comfortable during use.

In some implementations, the hammock 100, 400, 600 may be configured to accept an air mattress 195 within an interior compartment thereof (see, e.g., FIG. 1A).

In some implementations, a spreader bar may be placed between two adjacent suspension lines 108, 608.

In some implementations, not shown, a mosquito net or similar device may be configured to work with implementations of the hammock 100, 400, 600 disclosed herein. In some implementations, a mosquito net may be attached to the portions of the first side edge 128A and the second side edge 128B that are adjacent the head pocket 110 of the hammock 100. In some implementations, the mosquito net may be configured extend from the head pocket 110 to the end of the leg well 115. In this way, the torso, head, and/or upper portion of a user's legs may be covered by the mosquito net.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A hammock comprising:

a piece of material having a top side, a bottom side, a left side, a right side, a first side edge extending between the top side and the left side, and a second side edge extending between the top side and the right side, wherein the first and second side edges are tapered, the top side includes a first fold, and the bottom side includes a second fold;

a first suspension system and a second suspension system, wherein the first suspension system comprises a first length of flexible material secured within the first fold of the top side of the hammock, and the second suspension system comprises a second length of flexible material secured within the second fold of the bottom side of the hammock; and a first arm rest and a second arm rest, wherein the first arm rest comprises a portion of the piece of material adjacent the left side and the first side edge, and the second arm rest comprises a portion of the piece of material adjacent the right side and the second side edge;

wherein a portion of the first length of flexible material is secured in place within a middle portion of the first fold, a first side and a second side of the first fold are pleated;

wherein a portion of the second length of flexible material is secured in place within a middle portion of the second fold, a first side and a second side of the second fold are pleated;

wherein the middle portion of the second fold is wider than the middle portion of the first fold, thereby creating a first longitudinal stress line and a second longitudinal stress line therebetween, the first longitudinal stress line extends between a first side of the middle portion of the first fold and a first side of the middle portion of the second fold and the second longitudinal stress line extends between a second side of the middle portion of the first fold and a second side of the middle portion of the second fold;

wherein a head pocket is formed between the top side of the hammock and portions of the first longitudinal stress line and the second longitudinal stress line adjacent thereto; and wherein a leg well is formed between the bottom side of the hammock and portions of the first longitudinal stress line and the second longitudinal stress line adjacent thereto.

2. The hammock of claim 1, wherein the first length of flexible material of the first suspension system includes a first end and a second end and the second length of flexible material of the second suspension system includes a first end and a second end, the first end and the second end of the first length of material are individually configured for a suspension line to be secured thereto and the first end and the second end of the second length of material are individually configured for a suspension line to be secured thereto.

3. The hammock of claim 1, further comprising a blanket that is secured to at least a portion of the bottom side of the piece of material, the blanket is configured to extend from the leg well to the head pocket of the hammock.

4. The hammock of claim 1, further comprising a foot bag configured to envelop the feet of a user and any portion of the user's legs extending from the leg well, the foot bag is secured about an exit opening of the leg well.

5. The hammock of claim 1, wherein an exit opening of the leg well is located below a first end and a second end of the second length of flexible material of the second suspension system.

* * * * *